US006829833B2

(12) United States Patent
Langman

(10) Patent No.: US 6,829,833 B2
(45) Date of Patent: Dec. 14, 2004

(54) TOOL GUIDE

(76) Inventor: Thomas Langman, 4304 SE. 76th Ave., Portland, OR (US) 97206

( * ) Notice: Subject to any disclaimer, the term of this patent is extended or adjusted under 35 U.S.C. 154(b) by 0 days.

(21) Appl. No.: 10/389,137

(22) Filed: Mar. 14, 2003

(65) Prior Publication Data

US 2004/0177521 A1 Sep. 16, 2004

(51) Int. Cl.[7] ..... B43L 13/02
(52) U.S. Cl. ..... 33/32.2; 33/566
(58) Field of Search ..... 33/32.2, 18.1, 33/42, 562, 563, 566, 483

(56) References Cited

U.S. PATENT DOCUMENTS 709,776 A * 9/1902 Kelley ..... 33/566
2,722,055 A * 11/1955 Rader ..... 33/483
3,439,426 A * 4/1969 Wilson ..... 33/32.2
3,834,033 A * 9/1974 Pinkard ..... 33/563
4,924,594 A * 5/1990 Fernandes ..... 33/483
5,511,316 A * 4/1996 Fischer et al. ..... 33/1 F
5,946,999 A * 9/1999 Kahn ..... 33/32.1
6,321,547 B1 * 11/2001 Kidwell ..... 62/209
6,418,635 B1 * 7/2002 Nelson et al. ..... 33/563

* cited by examiner

*Primary Examiner*—Christopher W. Fulton
(74) *Attorney, Agent, or Firm*—Chernoff, Vilhauer, McClung & Stenzel, LLP

(57) ABSTRACT

A guide for steadying the path of a cutting tool and enabling force to be applied to compress a workpiece on opposing sides of the path of the tool.

8 Claims, 2 Drawing Sheets

TOOL GUIDE

CROSS-REFERENCE TO RELATED APPLICATIONS

Not applicable.

BACKGROUND OF THE INVENTION

The present invention relates to a guide for a tool and, more particularly, to a guide for steadying the path of a tool while enabling a compressive force to be applied to a workpiece on both sides of the path of the tool.

Many materials, such as, fiberglass thermal insulation, fiber batting, and foam materials, comprise sheets or batts of loosely amalgamated fibers or a matrix of relatively fragile cells. Typically, these materials are cut to size using a knife or other hand-held tool. However, the thickness of the sheet of material may be substantially greater than the length of the cutting element or blade of the tool. Further, the fragility of the sheet of material often makes it difficult to obtain a clean cut and avoid pulling material out of the sheet. The most effective method of cutting this type of material comprises compressing the material while repeatedly drawing a cutting tool across the workpiece. Compressing the material reduces the thickness of the workpiece and consolidates the fragile material reducing tear out to produce a cleaner cut.

Referring to FIG. 1, typically, a person desiring to cut sheet or workpiece of compressible material places a straightedge 20 on the upper surface 22 of the workpiece 24 at one side of the desired cutting path. Pressure applied to the straightedge with one hand compresses the material while the second hand draws the knife or other cutting tool 26 along the side of the straightedge to cut the material. Even when the material is compressed, several passes with the cutting tool 26 may be required to cut completely through the workpiece 24. When the tool 26 severs the material of the workpiece 24, the portion of the material on the side of the cut opposite the straightedge 20 is substantially free to expand toward its uncompressed state. If it is necessary to repeat drawing the tool 26 across the workpiece 24, the expanded material adjacent to the cutting path can interfere with the user's hand and the cutting tool 26. In addition to making it difficult to repeat the cutting action, the expanded material 28 can make it difficult to keep the cutting tool against the straightedge producing an uneven edge and often causing the fragile material to be torn from the workpiece.

What is desired, therefore, is a device to steady the path of the cutting tool and facilitate the application of force to compress the workpiece on both sides of the cut until the material is completely severed, even if several passes of the tool are required.

DETAILED DESCRIPTION OF THE INVENTION

Figure 1:
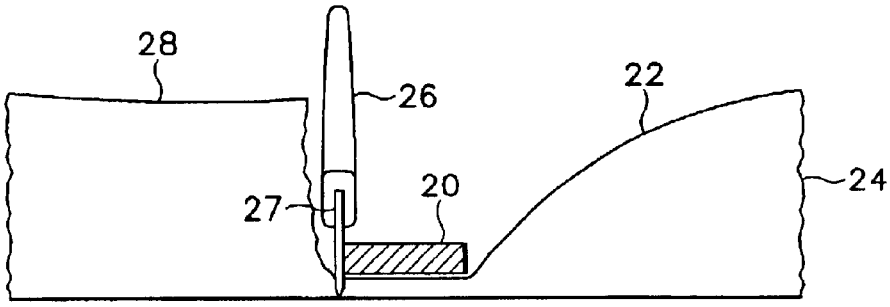
FIG.1 (PRIOR ART)
FIG. 1 illustrates a prior art method of cutting a sheet of a compressible material.

Cutting thick batts or sheets of loosely amalgamated fibers or fragile cellular material, such as fiberglass insulation, fiber batting, and foam, can be problematic. Referring in detail to the drawings wherein similar parts of the invention are identified by like reference numerals, and more particularly to FIG. 1, to effectively cut materials of this type with a knife or other handheld cutting tool 26, a person will typically place a straightedge 20 on the top surface 22 of the workpiece 24 along the proposed cutting path, apply force to the straightedge to compress the material and reduce its thickness, and then draw the cutting tool along the straightedge using the side to guide the motion of the tool. Several passes of the tool may be required to completely sever the material of the workpiece 24. Once the tool begins cutting, the material is severed along the cut and the material 28 on the side of the cut opposite the straightedge is no longer restrained and can expand substantially toward its uncompressed state. This material often interferes with the cutting tool and the hand of the person wielding it.

Figure 3:
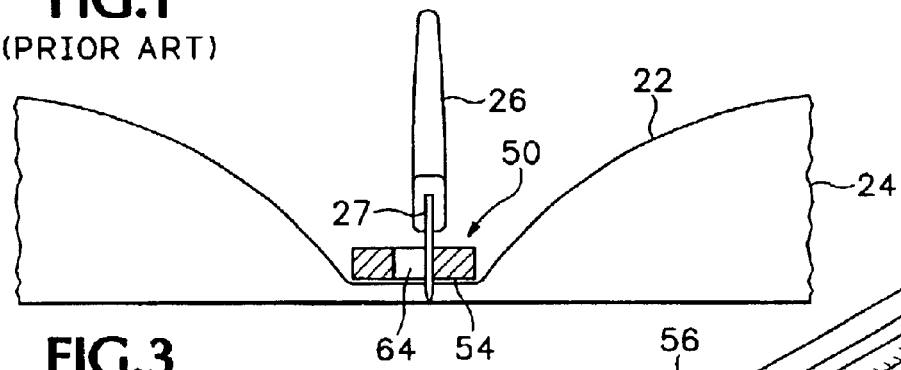
FIG. 3 is an end-view of the cutting guide of FIG. 2 illustrating compression of the workpiece on opposing sides of the cut during use.
Figure 2:
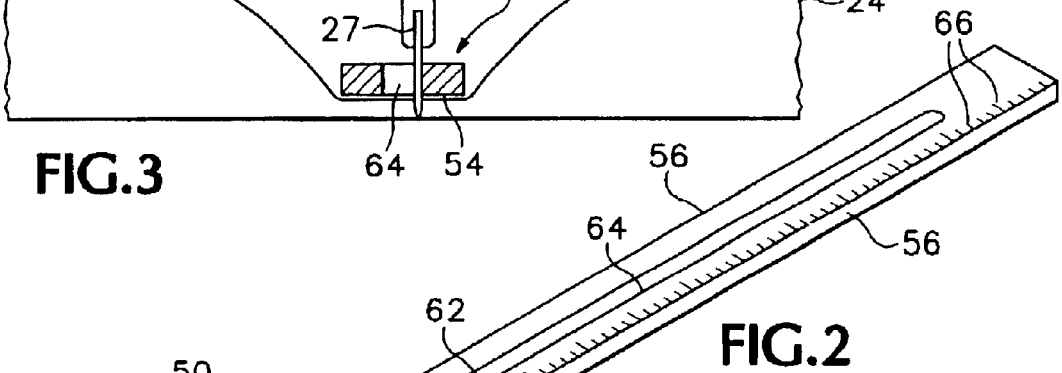
FIG. 2 is a perspective view of an embodiment of the inventive cutting guide.
Figure 4:
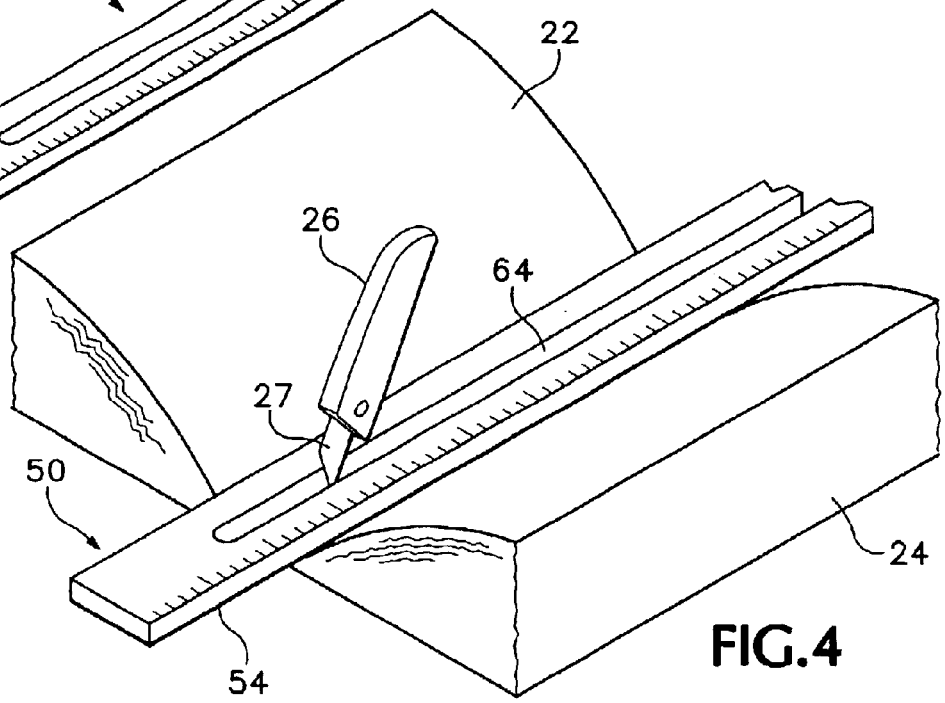
FIG. 4 is a perspective view of the cutting guide of FIG. 2 illustrating compression of a workpiece.

The present inventor concluded that maintaining pressure on both sides of the cutting path during repeated passes of the cutting tool would promote ease and effectiveness in cutting compressible material and produce cleaner cuts. Referring to FIGS. 2, 3, and 4, the cutting guide 50 of the present invention comprises, generally, a platen 52 having a substantially planar first surface 54 to be placed in contact with the upper surface 22 of a workpiece 24 to be cut. The individual using the cutting tool 26 can place one hand on the spaced apart upper, second surface 60 of the platen 52 and exert a force substantially normal to the surface 22 of the workpiece 24 to compress the material and reduce its thickness. Portions of the platen 52 define the edge 62 of an elongated aperture 64 that is displaced from the peripheral sides 56 of the platen 52. With the lower planar surface 54 of the guide 50 in contact with the upper surface 22 of the workpiece 24, the blade 27 of the cutting tool 26 can be inserted through the aperture 64 into the workpiece 24. The cutting tool 26 can be held against the edge 62 of the aperture 64 to steady the motion of the tool as it is drawn across the surface of the workpiece 24.

Figure 5:
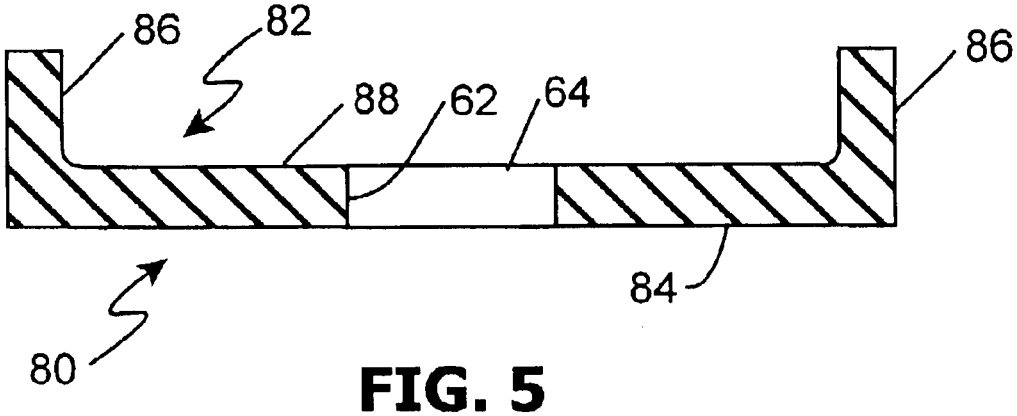
FIG. 5 is a cross-section of a channel-shaped platen for a cutting guide.
Figure 6:
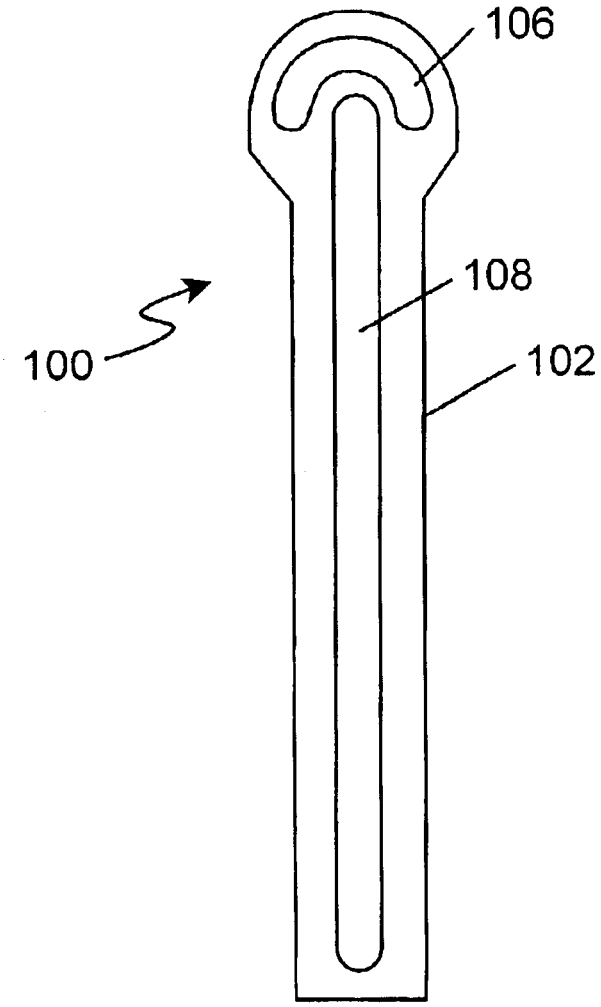
FIG. 6 is a bottom view of a platen of a cutting guide having a space shape configuration.

While the platen 52 of the cutting guide 50 illustrated in FIG. 2 is an elongated rectangular prism with ruling 66 along one edge of the upper surface, the cutting guide may employ a platen of another shape or cross-section. For example, FIG. 5 illustrates a platen 80 having a channel shaped cross-section comprising a base 82 having a substantially planar lower base surface 84 and a plurality of ribs 86 projecting from the upper surface 88 of the base 82. The channel shaped cross-section enhances the stiffness of a light weight platen. Likewise, the lower surface of the platen need not be rectangular. Referring to FIG. 6, the platen 102 of the cutting guide 100 can have a lower surface with the shape of any convenient space figure and may include one or more apertures 106, 108 with shapes to guide the cutting tool on any desired cutting path.

To use the cutting guide, the user places the guide 50 on the upper surface 22 of the workpiece 24 to be cut with the aperture 64 aligned with proposed cutting path. The user applies force to the upper surface 60 of the platen 52 with a first hand to compress the material under the guide to reduce the thickness of the workpiece 24 and consolidate the material to reduce tear out. With the second hand, the user inserts the cutter 27 of the tool 26 into the aperture 64 so that the cutter 27 projects below the lower surface 54 of the guide and into the material to be cut. While the aperture need only be sufficiently wide to permit the cutter 27 of the cutting tool 26 to be inserted, the present inventor determined that an aperture 64 approximately 0.5 inch wide or wider will permit inserting the end of a typical utility knife through the platen 54 increasing the depth of the cut that is possible with a cutting element of fixed length. With the cutter 27 of the tool 26 engaging the material of the workpiece 24, the user can draw the tool across the workpiece using the edge 62 of the aperture 64 to steady the tool and guide its path of travel. Since the aperture 64 and, therefore, the cutting path of the tool 26 is displaced from the periphery of the platen 52, the lower surface 54 of the guide 50 remains in contact with the surface 22 of the workpiece 24 on both sides of the cutting path of the tool. With continued exertion of force on the cutting guide, the user can continue compression of the material of the workpiece 24 and enjoy unobstructed access to the cutting path during repeated passes of the tool 26.

The detailed description, above, sets forth numerous specific details to provide a thorough understanding of the present invention. However, those skilled in the art will appreciate that the present invention may be practiced without these specific details. In other instances, well known methods, procedures, and components have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

What is claimed is:

1. A tool guide to facilitate cutting a compressible workpiece, said tool guide comprising a platen having a substantially planar first surface for contact with a surface of said workpiece, a substantially planar second surface spaced apart from said first surface, and a periphery bounding said first and said second surfaces, said platen including portions defining a first edge and a second edge of an aperture connecting said first surface and said second surface, said first edge and said second edge being spaced from said periphery such that application of force to said second surface will cause a reduction in a thickness of said compressible workpiece adjacent said aperture and sufficiently spaced apart from each other to permit a portion of a handle of a separate utility knife including a cutting tool inserted into said aperture to project from said first surface, one of said first surface and said second surface being engageable by one of said handle and said cutting tool to guide movement of said cutting tool.

2. The tool guide of claim 1 wherein said first surface, said second surface, and said periphery of said platen define generally an elongated rectangular prism.

3. The tool guide of claim 1 wherein said periphery of said platen defines a rectangular first surface.

4. The tool guide of claim 1 wherein said first edge and said second edge of said aperture are spaced apart by a distance of at least one-half inch.

5. A tool guide to facilitate cutting a compressible workpiece; said guide comprising a platen having a substantially planar first surface for contact with a surface of said workpiece; a second surface spaced apart from said first surface; a rib projecting from said second surface, and at least one peripheral side bounding said first and said second surfaces, said platen including portions defining a first edge and a second edge of an aperture connecting said first surface and said second surface, said first edge and said second edge being displaced from said at least one peripheral side of said platen so that force applied to said second surface will reduce a thickness of said compressible workpiece adjacent said aperture and sufficiently spaced from each other to permit a portion of a handle of a separate utility knife including a cutting tool to be inserted through said aperture and project from said first surface; said rib being spaced apart from said first edge and said second edge of said aperture.

6. A guide for steadying a path of a tool and enabling compression of a workpiece on opposing sides of said path; said guide comprising a platen having a substantially planar first surface for contact with a surface of said workpiece; a second surface spaced apart from said first surface; a rib projecting from said second surface, and at least one peripheral side bounding said first and said second surfaces, said platen including portions defining an edge of an aperture connecting said first surface and said second surface, said edge being engageable by a tool and displaced from said at least one peripheral side of said platen, said second edge being spaced apart sufficiently from said first edge to permit a portion of a handle of a utility knife to be inserted into said aperture; said rib being spaced apart from said edge of said aperture.

7. A guide for steadying a path of a tool and enabling compression of a workpiece on opposing sides of said path; said guide comprising a platen having a substantially planar first surface for contact with a surface of said workpiece; a second surface spaced apart from said first surface; a rib projecting from said second surface, and at least one peripheral side bounding said first and said second surfaces, said platen including portions defining an edge of an aperture connecting said first surface and said second surface, said edge being engageable by a tool and displaced from said at least one peripheral side of said platen, said second edge being spaced apart from said first edge by a distance of at least one-half inch; said rib being spaced apart from said edge of said aperture.

8. A method for cutting a compressible workpiece comprising the steps of:

(a) compressing said workpiece by applying a force to a second surface of a platen, said platen including a first surface in contact with said workpiece, said second surface, and a periphery bounding said first and said second surfaces, said platen including portions defining a first edge and a second edge of an elongated aperture connecting said first and said second surfaces, said first edge and said second edge being spaced from said periphery so that application of force to said second surface reduces a thickness of said compressible workpiece adjacent said aperture and being sufficiently separated from each other to permit a portion of a handle of a utility knife to be inserted into said aperture and project from said first surface;

(b) inserting a blade of a cutting tool through said aperture into said compressed workpiece, and (c) moving said blade substantially parallel to at least one of said first and said second edges of said aperture to sever said workpiece.

* * * * *